US011651889B2

(12) United States Patent
Lim et al.

(10) Patent No.: US 11,651,889 B2
(45) Date of Patent: May 16, 2023

(54) REINFORCED INSULATION TRANSFORMER AND DESIGN METHOD THEREOF

(71) Applicant: LSIS CO., LTD., Anyang-si (KR)

(72) Inventors: Deok Young Lim, Anyang-si (KR); Chun Suk Yang, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 808 days.

(21) Appl. No.: 16/573,239

(22) Filed: Sep. 17, 2019

(65) Prior Publication Data

US 2020/0286679 A1 Sep. 10, 2020

(30) Foreign Application Priority Data

Mar. 7, 2019 (KR) ..... 10-2019-0026117

(51) Int. Cl.

| | |
|---|---|
| ***H01F 27/32*** | (2006.01) |
| ***H01F 30/16*** | (2006.01) |
| ***H01F 27/28*** | (2006.01) |
| ***H01F 27/26*** | (2006.01) |
| ***H01F 27/30*** | (2006.01) |

(52) U.S. Cl.

CPC ..... *H01F 27/324* (2013.01); *H01F 27/263* (2013.01); *H01F 27/2823* (2013.01); *H01F 27/306* (2013.01); *H01F 30/16* (2013.01)

(58) Field of Classification Search

None

See application file for complete search history.

(56) References Cited

U.S. PATENT DOCUMENTS 2,534,119 A 12/1950 Gethmann
5,838,220 A * 11/1998 Hagberg ..... H01F 41/12 336/229
2001/0010269 A1 8/2001 Higashiura et al.

(Continued)

FOREIGN PATENT DOCUMENTS

CN 1241282 A 1/2000
CN 1358317 A 7/2002

(Continued)

OTHER PUBLICATIONS

Korean Office Action for related Korean Application No. 10-2019-0026117; action dated Mar. 3, 2020; (6 pages).

(Continued)

*Primary Examiner* — Jared Fureman
*Assistant Examiner* — Aqeel H Bukhari
(74) *Attorney, Agent, or Firm* — K&L Gates LLP

(57) ABSTRACT

The present disclosure relates to a reinforced insulation transformer and a design method thereof. The reinforced insulation transformer according to an embodiment of the present disclosure is a transformer in which a secondary winding is wound on a primary winding so that the primary winding and the secondary winding have a stacked structure and satisfy a reinforced insulation criterion, wherein each of the primary winding and the secondary winding includes a conducting wire and an insulation outer layer that surrounds the conducting wire, and the insulation outer layer of the secondary winding has more layers or a greater thickness than the insulation outer layer of the primary winding.

15 Claims, 9 Drawing Sheets

200 : 210, 220, 230
300 : 310, 311, 320, 321

(56) References Cited

U.S. PATENT DOCUMENTS

| | | | | |
|---|---|---|---|---|
| 2002/0033748 | A1* | 3/2002 | Bolotinsky | H01F 30/16<br>336/182 |
| 2013/0002385 | A1 | 1/2013 | Kwon et al. | |
| 2018/0190429 | A1* | 7/2018 | Padhye | H01F 41/06 |

FOREIGN PATENT DOCUMENTS

| | | | |
|---|---|---|---|
| EP | 0944099 | A1 | 9/1999 |
| JP | 4-131918 | U | 12/1992 |
| JP | 05087921 | U | 11/1993 |
| JP | H08195319 | A | 7/1996 |
| JP | 11176244 | A | 7/1999 |
| JP | 2002118021 | A | 4/2002 |
| JP | 2012164928 | A | 8/2012 |
| JP | 2018170397 | A | 11/2018 |
| KR | 20010067271 | A | 7/2001 |
| KR | 20180115870 | A | 10/2018 |

OTHER PUBLICATIONS

European Search Report for related European Application No. 19198461.6; action dated Mar. 20, 2020; (9 pages).
Office Action for related Chinese Application No. 201910894200.9; action dated Mar. 19, 2023; (8 pages).

* cited by examiner

200 : 210, 220, 230
300 : 310, 311, 320, 321

(a)

(b)

(c)

REINFORCED INSULATION TRANSFORMER AND DESIGN METHOD THEREOF

CROSS-REFERENCE TO RELATED APPLICATION

Pursuant to 35 U.S.C. § 119(a), this application claims the benefit of earlier filing date and right of priority to Korean Patent Application No. 10-2019-0026117, filed on Mar. 7, 2019, the disclosure of which is incorporated herein by reference in its entirety.

BACKGROUND

1. Field of the Invention

The present disclosure relates to a reinforced insulation transformer and a design method thereof, and more particularly, to a transformer capable of implementing a reinforced insulation structure between a primary power source and a secondary power source with a minimum volume, and a design method thereof.

2. Discussion of Related Art

Various electronic devices or apparatuses require various types of power. Accordingly, each of the electronic devices or apparatuses is provided with a power supply that converts alternating current (AC) power supplied from the outside into power required by the corresponding electronic device or apparatus.

Examples of such a power supply include a series regulator method and a switching mode method.

The series regulator method is a method of converting AC power using a transformer and is mainly used for a TV receiver, a cathode ray tube (CRT) monitor, and the like. Such a series regulator method has a simple peripheral circuit and is inexpensive but has a disadvantage in that a great deal of heat is generated, power efficiency is low, and a volume thereof is large.

The switching mode method is a method of converting AC power using a switching element and has an advantage in that little heat is generated, power efficiency is high, and a volume thereof is small in comparison to the series regulator method. A power supply of such a switching mode method is typically referred to as a switching mode power supply (SMPS). In particular, the SMPS is high in efficiency, durable, and advantageous in miniaturization and being light weight, and thus used as a power supply for most electronic devices, equipment, and systems for communication, industrial purposes, personal computers (PCs), office automation (OA) equipment, and home appliances.

The SMPS is basically provided with a transformer. Here, the transformer for an SMPS includes a core that is a magnetic body, a bobbin that is a frame for insulating and winding, and primary and secondary windings that are wound on the bobbin and transfer primary power and secondary power, respectively. Accordingly, the SMPS may convert power using the phenomenon of electromagnetic induction that is generated in the primary and secondary windings.

Meanwhile, an inverter is a device for converting direct current (DC) into AC and generates an AC voltage by switching a DC voltage using a switching element, which is turned on/off according to a pulse width modulation (PWM) signal, and outputs the generated AC voltage to loads. The SMPS is provided to supply power to a controller and other peripheral devices of the inverter. That is, in the inverter, low voltage power generated by the SMPS is processed and used for the purpose of operation, protection, and control.

In the SMPS of the inverter, each power source (or each winding) is electrically insulated from each other (hereinafter referred to as "insulation"). Here, between power sources (for example, between primary power sources, between the secondary power sources, or between the primary power source and the secondary power source), an insulation class of the power source is determined according to the usage position of each power source. Here, the insulation class is an insulation criterion for safety and may be classified into three types of functional insulation, basic insulation, and reinforced insulation.

In particular, when the secondary power source is an externally located power source (for example, an I/O power source) that may be in direct contact with a user, the reinforced insulation should be necessarily implemented. However, the conventional method for implementing the reinforced insulation merely proposes to simply increase an insulation distance between a primary power source and a secondary power source. Accordingly, when the conventional method is applied, there is a problem that the volume of a transformer for an inverter SMPS increases due to an increase in the insulation distance.

SUMMARY

The present disclosure is directed to providing a transformer capable of implementing a reinforced insulation structure between a primary power source and a secondary power source with a minimum volume, and a design method thereof.

However, objectives to be achieved by embodiments of the present disclosure are not limited to the above-described objective, and other objectives, which are not described above, may be clearly understood by those skilled in the art through the following specification.

According to an aspect of the present disclosure, there is provided a reinforced insulation transformer, in which a secondary winding is wound on a primary winding so that the primary winding and the secondary winding have a stacked structure and satisfy a reinforced insulation criterion, wherein each of the primary winding and the secondary winding includes a conducting wire and an insulation outer layer that surrounds the conducting wire, and the insulation outer layer of the secondary winding has more layers or a greater thickness than the insulation outer layer of the primary winding.

The secondary winding may include the insulation outer layer that is composed of a plurality of layers to satisfy a withstand voltage of a basic insulation criterion.

The insulation outer layer of the secondary winding may have a triple layer.

A lead-out portion of each of the primary winding and the secondary winding may be surrounded by an insulating tube, and the lead-out portion may be adjacent to a pin.

The insulating tube may include a Teflon tube.

A total barrier distance of each of the primary winding and the secondary winding may be smaller than a separation distance of the reinforced insulation criterion.

The total barrier distance of each of the primary winding and the secondary winding may be within a range of separation distances that satisfy the basic insulation criterion.

The reinforced insulation transformer according to an embodiment of the present disclosure may be included as a configuration of a power supply for an inverter.

According to another aspect of the present disclosure, there is provided a design method of a reinforced insulation transformer in which a primary winding and a secondary winding form a stacked structure and a reinforced insulation criterion is satisfied between the primary winding and the secondary winding, the design method including forming the primary winding by winding, and forming the secondary winding by winding on the primary winding, wherein each of the primary winding and the secondary winding includes a conducting wire and an insulation outer layer that surrounds the conducting wire, and the insulation outer layer of the secondary winding has more layers or a greater thickness than the insulation outer layer of the primary winding.

The design method of the reinforced insulation transformer according to the embodiment of the present disclosure may further include surrounding a lead-out portion of each of the primary winding and the secondary winding by an insulating tube, wherein the lead-out portion is adjacent to a pin.

BRIEF DESCRIPTION OF THE DRAWINGS

The above and other objects, features, and advantages of the present disclosure will become more apparent to those of ordinary skill in the art by describing exemplary embodiments thereof in detail with reference to the accompanying drawings, in which.

DETAILED DESCRIPTION OF THE EMBODIMENTS

Figure 1:
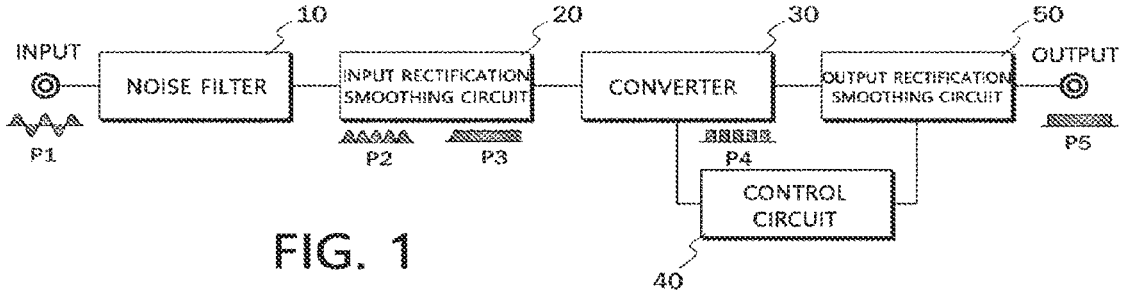
FIG. 1 illustrates a block configuration diagram of a general switching mode power supply (SMPS)

The above-described objects and means of the present disclosure and the effects associated therewith will become more apparent through the following detailed description in conjunction with the accompanying drawings. Accordingly, those skilled in the art to which the present disclosure pertains can readily implement the technical spirit of the present disclosure. In addition, when it is determined that detailed descriptions of related well-known functions unnecessarily obscure the gist of the present disclosure during the description of the present disclosure, the detailed descriptions will be omitted.

Terms used herein are for the purpose of describing embodiments only and are not intended to limit the present disclosure. In the present specification, the singular forms "a," "an," and "the" are intended to include the plural forms as well in some cases, unless the context clearly indicates otherwise. In the present specification, terms such as "comprises," "comprising," "includes," "including," "has," and/or "having," do not preclude the presence or addition of one or more other components other than the components mentioned.

In the present specification, terms such as "or,", "at least one," and the like may represent one of the words listed together or may represent a combination of two or more. For example, "A or B" and "at least one of A and B" may include only one of A or B, and may include both A and B.

In the present specification, descriptions following "for example" may not exactly match the information presented, such as cited characteristics, variables, or values, and embodiments of the disclosure according to various embodiments of the present disclosure should not be limited by effects such as modifications including limits of tolerances, measurement errors, and measurement accuracy, and other commonly known factors.

In the present specification, when it is described that one component is "connected" or "joined" to another component, it should be understood that the one component may be directly connected or joined to another component but an additional component may be present therebetween. However, when one component is described as being "directly connected," or "directly coupled" to another component, it should be understood that the additional component may be absent between the one component and another component.

In the present specification, when one component is described as being "on" or "facing" another component, it should be understood that the one component may be directly in contact with or connected to another component, but additional component may be present between the one component and another component. However, when one component is described as being "directly on" or "in direct contact with" another component, it should be understood that there is no additional component between the one component and another component. Other expressions describing the relationship between components, such as "between ~," "directly between ~," and the like should be interpreted in the same way In the present specification, terms such as "first" and "second" may be used to describe various components, but the components should not be limited by the above terms. In addition, the above terms should not be interpreted as limiting the order of each component but may be used for the purpose of distinguishing one component from another. For example, a "first element" could be termed a "second element", and similarly, a "second element" could also be termed a "first element".

Unless defined otherwise, all terms used herein may be used in a sense commonly understood by those skilled in the art to which the present disclosure pertains. In addition, it should be understood that terms, such as those defined in commonly used dictionaries, will not be interpreted in an idealized or overly formal sense unless expressly so defined herein.

Hereinafter, an exemplary embodiment of the present disclosure will be described in detail with reference to the attached drawings.

FIG. 1 illustrates a block configuration diagram of a general switching mode power supply (SMPS).

The SMPS is a device that converts alternating current (AC) power using a switching element, and as shown in FIG. 1, may include a noise filter 10, an input rectification smoothing circuit 20, a converter 30, a control circuit 40, and an output rectification smoothing circuit 50. However, FIG. 1 is an example of a configuration of an SMPS and is not limited to an SMPS for an inverter.

The noise filter 10 is a component that removes the noise of an AC power P1 that is input through an input terminal. That is, the noise filter 10 may prevent the noise in the input terminal from damaging internal circuit elements and may minimize a phenomenon in which a current has irregularly fluctuated. However, the noise filter 10 is a component for an auxiliary function such as preventing power noise generated in the SMPS from flowing into an input system and thus may not be an essential component of the SMPS for an inverter.

The input rectification smoothing circuit 20 is a component that performs rectification and smoothing functions on input power and may include an input rectification circuit and an input smoothing circuit. Here, the input rectification circuit may generate a rectified power P2 by converting the AC power that has passed through the noise filter 10 or the like. For example, the input rectification circuit may include a bridge diode circuit or the like, but the present disclosure is not limited thereto. In addition, the input smoothing circuit may generate a smoothed power P3 by converting the rectified power P2 having a ripple current which has passed through the input rectification circuit. That is, the input smoothing circuit may cause some constant voltage to be output by lowering a high voltage and raising a low voltage. For example, the input smoothing circuit may include a capacitor or an inductor, but the present disclosure is not limited thereto.

The converter 30 is a component that converts the smoothed power P3 into a power P4 of a desired magnitude. That is, the converter 30 may adjust the magnitude of the final output direct current (DC) power according to an on/off time of the switching element. For example, the switching element may be formed of transistors such as a gate turn-off thyristor (GTO), a bipolar junction transistor (BJT), an insulated-gate bipolar transistor (IGBT), a metal-oxide-semiconductor field-effect transistor (MOSFET), or the like, but the present disclosure is not limited thereto.

In particular, the converter 30 is the main part responsible for power conversion and may be classified into many types of converters according to the magnitude of an input/output change ratio and a circuit configuration. For example, the converter 30 may be mainly divided into a non-insulated type and an insulated type depending on the presence or absence of a high-frequency transformer. Here, the non-insulated type may include a buck type, a boost type, a buck-boost type, a C'uk type, and the like, and the insulated type may include a flyback type, a forward type, a full-bridge type, a half-bridge type, and the like, but the present disclosure is not limited thereto.

The control circuit 40 is a component that controls the converter 30. That is, the control circuit 40 may control the on/off time of the switching element. For example, a pulse width modulation (PWM) method or a pulse frequency modulation (PFM) method may be used as the control method, but the present disclosure is not limited thereto. In addition, the control circuit 40 may be a feedback control circuit for stabilizing the final output DC voltage or may further include the feedback control circuit.

The output rectification smoothing circuit 50 is a component that performs the rectification and smoothing functions on the power P4, which is converted by the converter 30, to generate the final power and may include an output rectification circuit and an output smoothing circuit. That is, the output rectification circuit may additionally perform a rectification function on the power that is converted by the converter 30. For example, the output rectification circuit may include a diode or the like, but the present disclosure is not limited thereto. In addition, the output smoothing circuit may generate a smoothed final power P5 by converting the power that has passed through the output rectification circuit. That is, the output smoothing circuit may cause some constant voltage to be output by lowering a high voltage and raising a low voltage. For example, the output smoothing circuit may include a capacitor or an inductor, but the present disclosure is not limited thereto.

Figure 2:
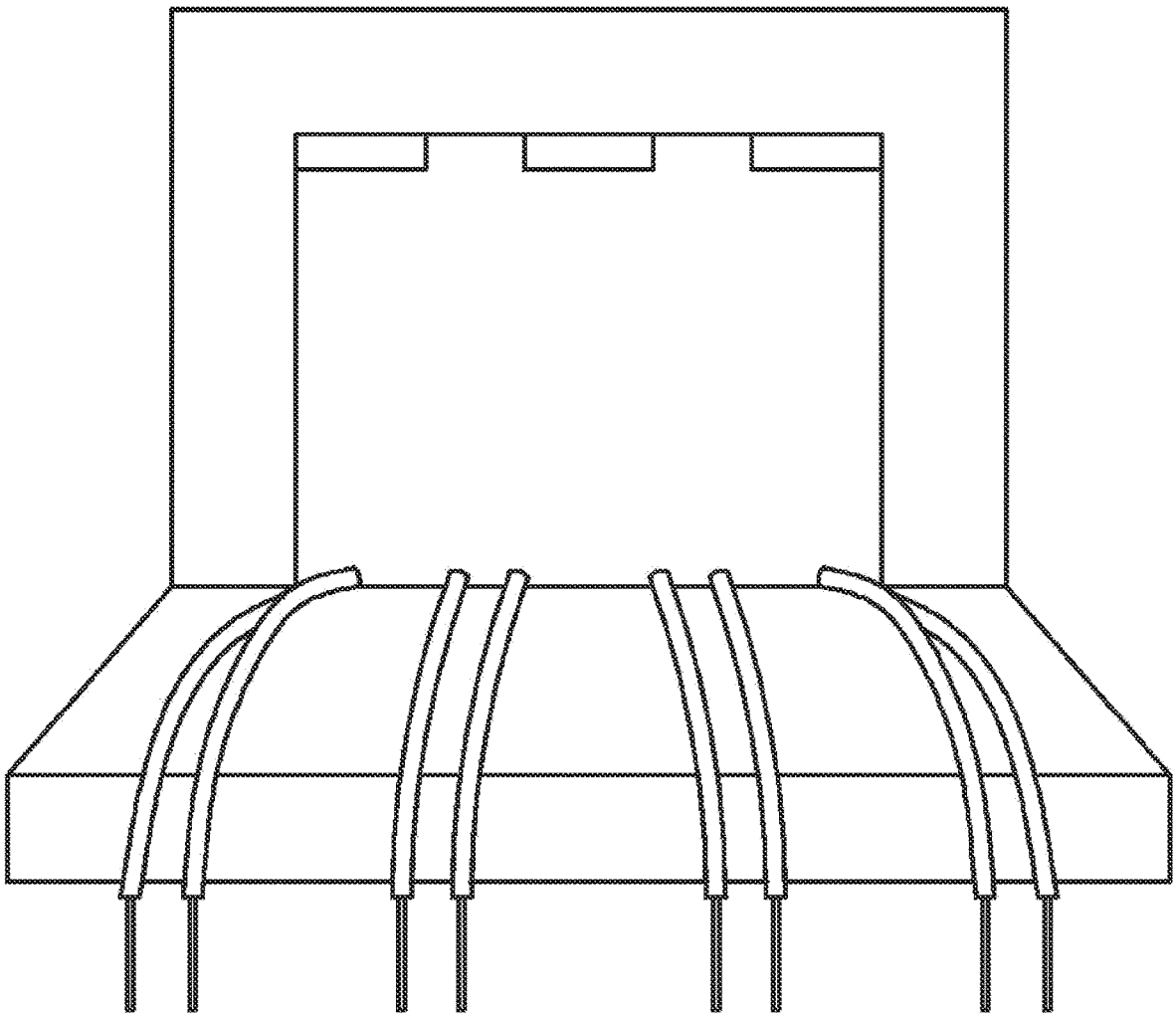
FIG. 2 illustrates a front photograph of a reinforced insulation transformer according to an embodiment of the present disclosure.
Figure 3:
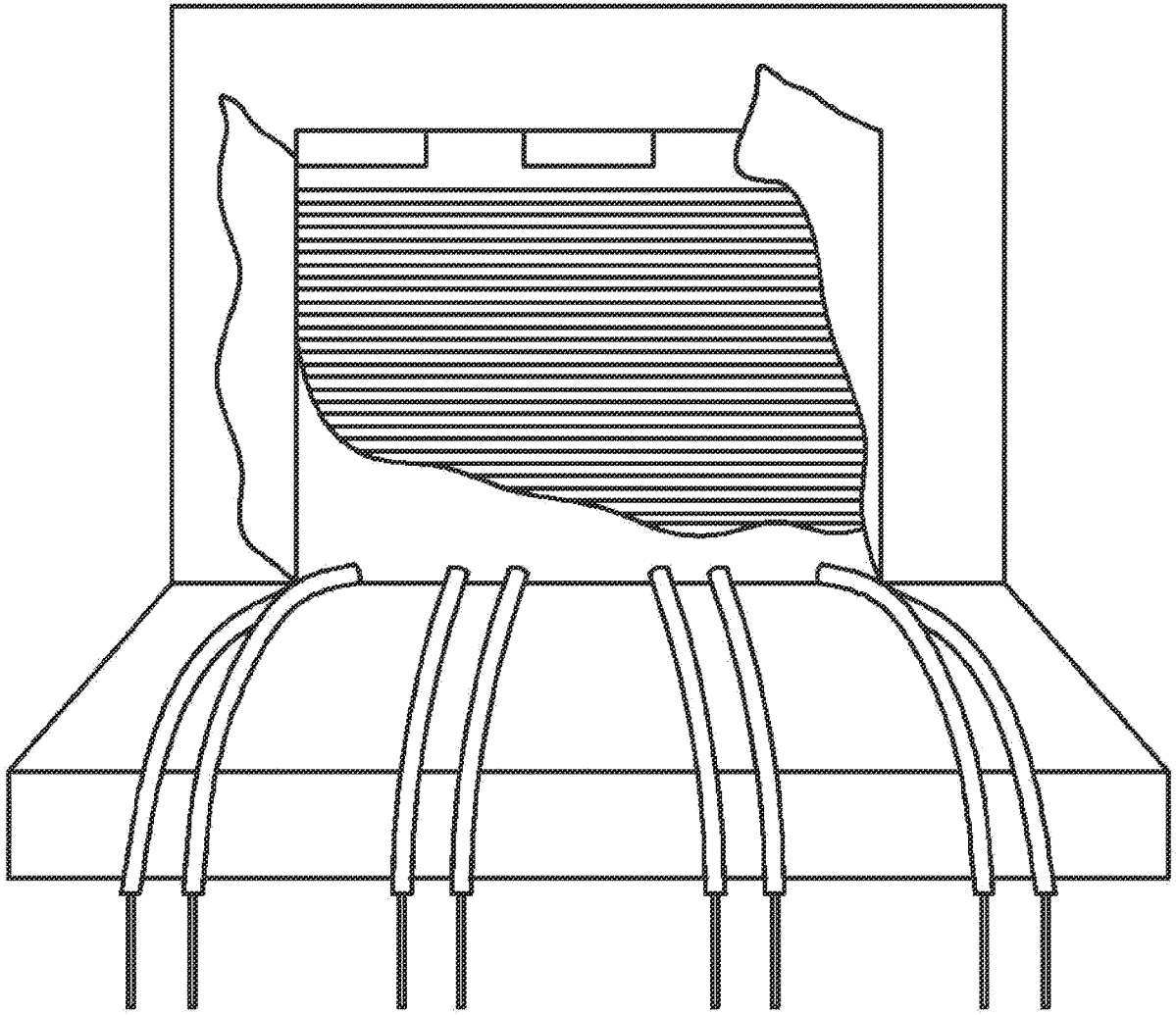
FIG. 3 illustrates a photograph in a case in which an insulating layer is removed in FIG. 2.
Figure 4:
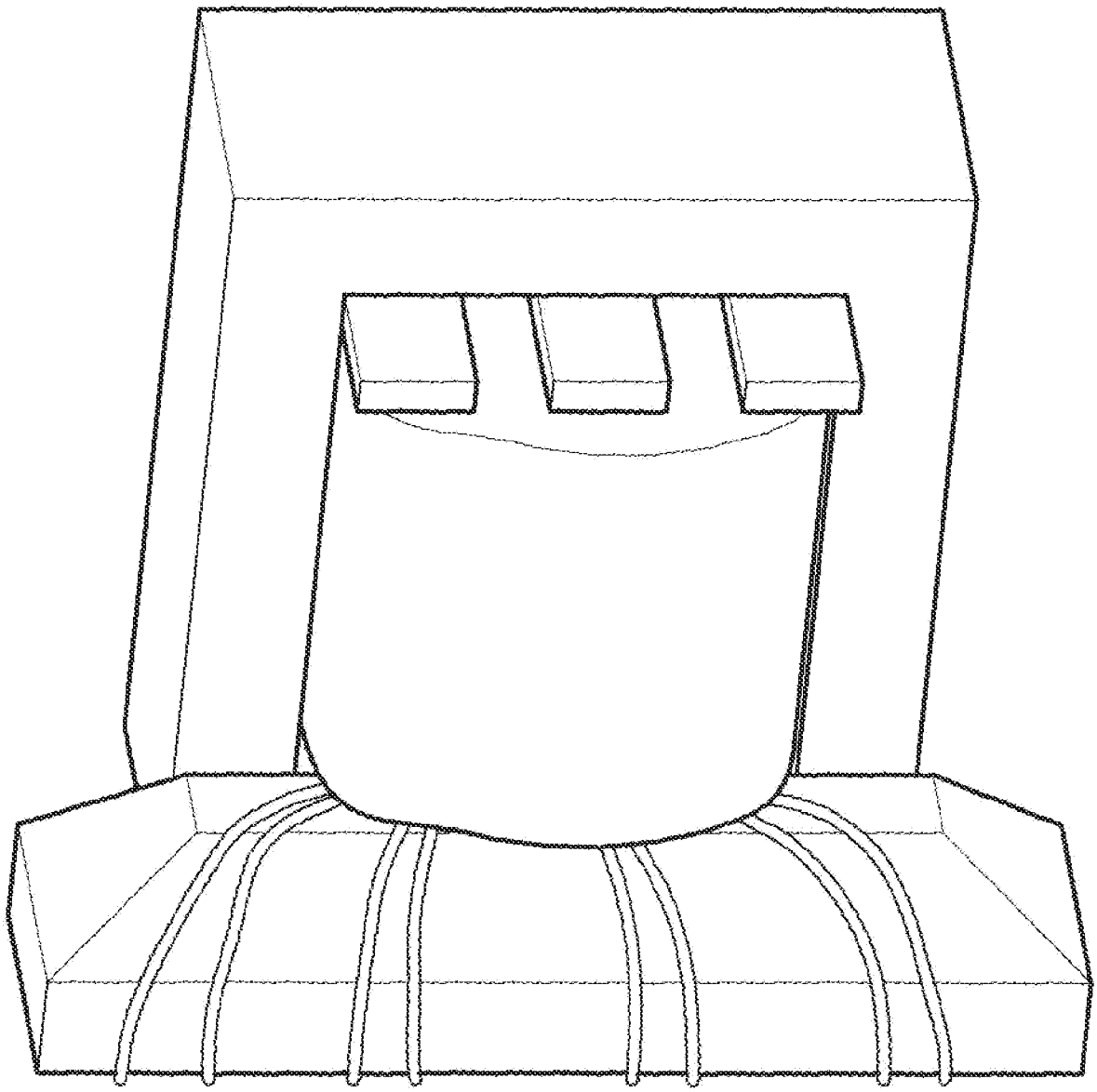
FIG. 4 illustrates a perspective photograph of the reinforced insulation transformer according to an embodiment of the present disclosure.

FIGS. 2 and 4 illustrate a front photograph and a perspective photograph of a reinforced insulation transformer according to an embodiment of the present disclosure, respectively, and FIG. 3 illustrates a photograph in a case in which an insulating layer is removed in FIG. 2.

The reinforced insulation transformer according to the embodiment of the present disclosure uses an electromagnetic induction phenomenon to output secondary power in which the magnitude of primary power is lowered. For example, the reinforced insulation transformer according to the embodiment of the present disclosure is a component that is included in an SMPS, especially an SMPS for an inverter, and may be provided between the input rectification smoothing circuit 20 and the converter 30, or between the converter 30 and the output rectification smoothing circuit 50.

That is, the reinforced insulation transformer according to the embodiment of the present disclosure receives a smoothed power P3 as primary power and outputs secondary power, in which the magnitude of the primary power is lowered according to an electromagnetic induction phenomenon, to transmit the secondary power to the converter 30. Further, the reinforced insulation transformer according to the embodiment of the present disclosure receives a power P4, which is converted by the converter 30, as primary power, and outputs secondary power, in which the magnitude of the primary power is lowered according to an electromagnetic induction phenomenon, to transmit the secondary power to the output rectification smoothing circuit 50. However, the present disclosure is not limited to being used only as a power conversion configuration of the above-described SMPS and may also be used as a power conversion configuration of various other electronic devices and apparatuses.

Figure 5:
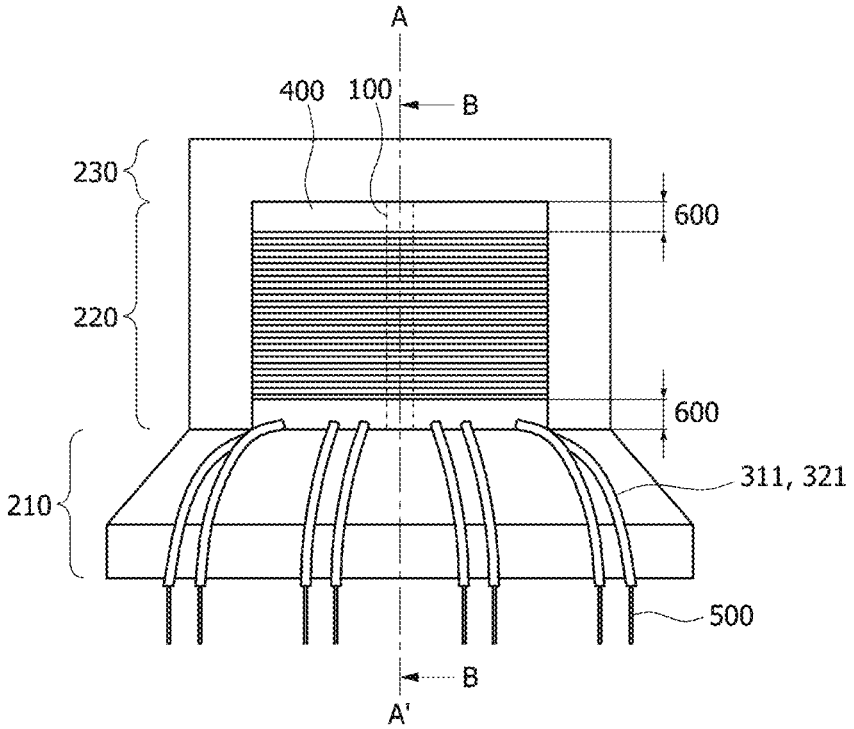
FIG. 5 illustrates a configuration of the reinforced insulation transformer according to an embodiment of the present disclosure, which is illustrated with reference to FIG. 4.
Figure 6:
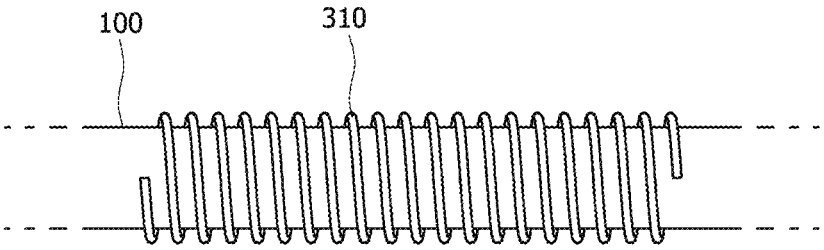
FIG. 6 illustrates an example of a core (100), a primary winding (310), a secondary winding (320), and an insulating layer (400)
Figure 6:
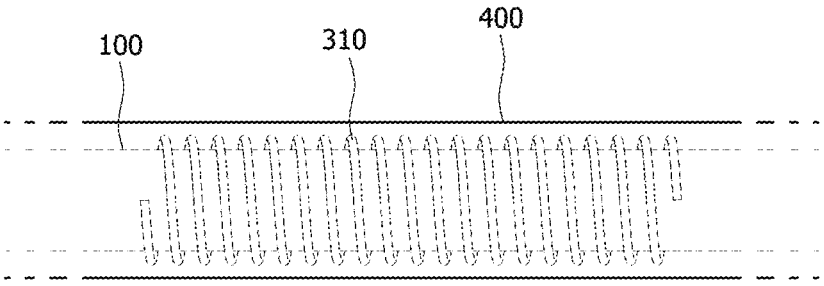
Figure 6:
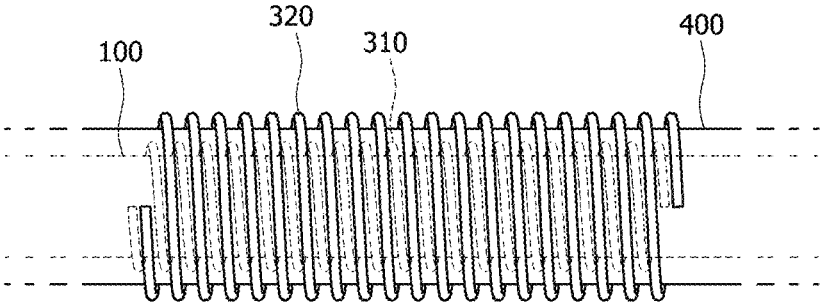
Figure 7:
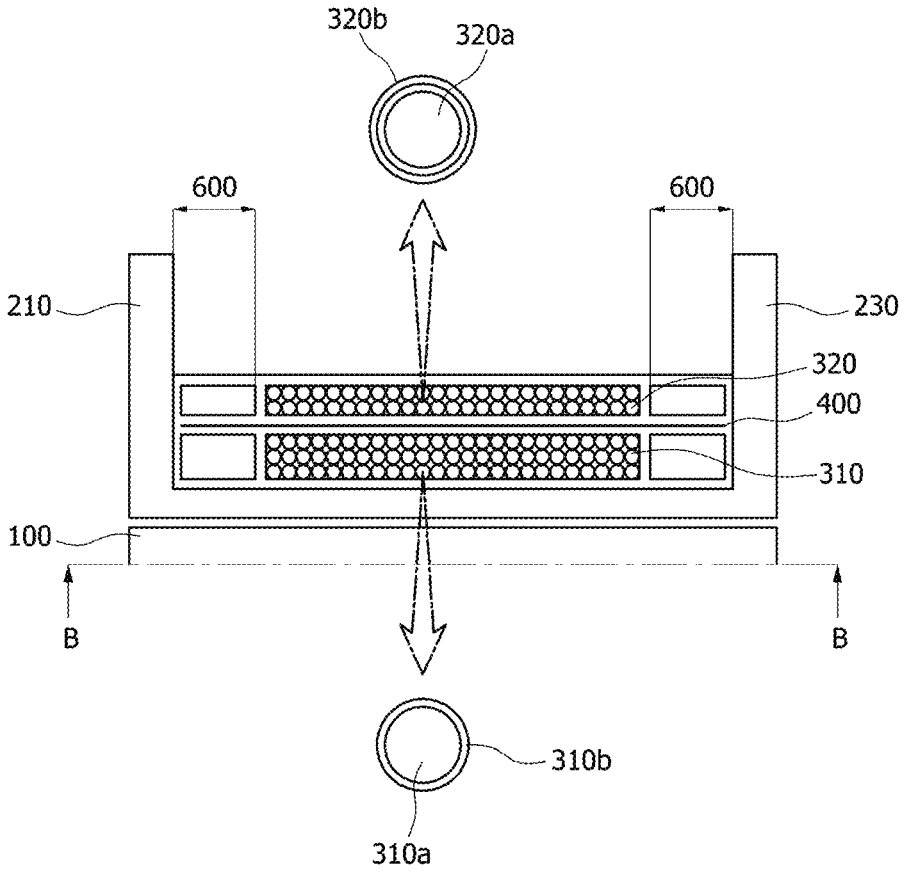
FIG. 7 illustrates a part of a cross-section of FIG. 5.

FIG. 5 illustrates a configuration of the reinforced insulation transformer according to the embodiment of the present disclosure, which is illustrated with reference to FIG. 4, and FIG. 6 illustrates an example of a core 100, a primary winding 310, a secondary winding 320, and an insulating layer 400. Further, FIG. 7 illustrates a part of a cross-section of FIG. 5. That is, FIG. 7 illustrates a part of a cut surface between A and A' viewed from B direction in FIG. 5.

Referring to FIGS. 5 to 7, the reinforced insulation transformer according to the embodiment of the present disclosure may include a core 100, a bobbin 200, a winding 300, an insulating layer 400, pins 500, and barriers 600.

The core 100 is a component that includes a magnetic material and may be centered when the winding 300 is wound. That is, the core 100 may be a component for smoothing energy transfer from a primary side to a secondary side.

The bobbin 200 is a component for supporting or housing the remaining components of the present disclosure, such as the core 100, the winding 300, the insulating layer 400, and the pin 500. Here, the bobbin 200 may include a pin portion 210, a central portion 220, and a top portion 230. That is, the pin portion 210 is a portion that supports the pin 500. The central portion 220 is a portion that supports the core 100, the winding 300, the insulating layer 400, the barriers 600, and the like, and corresponds to a portion of a hollow part in which the core 100, the winding 300, the insulating layer 400, the barrier 600, and the like are seated. In addition, the top portion 230 is a portion that is provided on the opposite side of the pin portion 210 with respect to the central portion 220.

The winding 300 is a component which is wound and in which an electromagnetic induction phenomenon is generated. Here, the winding 300 may include a primary winding 310 to which primary power is transmitted and a secondary winding 320 to which secondary power is transmitted. That is, the primary power may include high voltage power such as 200 V and 400 V. In addition, the secondary power may include low voltage power such as 12 V and may be a power source with which a user may come into direct contact.

A power conversion principle by the primary winding 310 and the secondary winding 320 is as described below. That is, when AC power is applied to the primary winding 310, magnetic flux is generated by the current of the corresponding power. Here, electromotive force may be induced in the secondary winding 320 in a direction in which a change in the generated magnetic flux is disturbed.

The primary winding 310 and the secondary winding 320 are composed of conducting wires 310*a* and 320*a*, which are made of a conductive material, and coated portions that surround the conducting wires 310*a* and 320*a*, respectively. That is, the primary winding 310 and the secondary winding 320 may include insulation outer layers 310*b* and 320*b*, respectively, which are made of an insulating material such as enamel.

Referring to FIG. 6, the primary winding 310 and the secondary winding 320 may have a structure stacked on each other and separated (hereinafter, a distance separated in such a manner is referred to as a "vertical separation distance") from each other, and the insulating layer 400 may be provided therebetween. That is, after the primary winding 310 is wound on the core 100, the insulating layer 400 covers the primary winding 310. Thereafter, the secondary winding 320 is wound again on the insulating layer 400, and the insulating layer 400 may cover the secondary winding 320 again. However, unlike the above, the insulating layer 400 may be omitted, which is provided in the space of the vertical separation distance between the primary winding 310 and the secondary winding 320.

Meanwhile, although FIGS. 6 and 7 illustrate that one primary winding 310 and one secondary winding 320 are provided, the present disclosure is not limited thereto. That is, a plurality of primary windings 310 and a plurality of secondary windings 320 may be further stacked. In particular, the plurality of primary windings 310 may be connected to each other, or the plurality of secondary windings 320 may be connected to each other, and in this case, the effect of increasing the number of turns of the primary winding 310 or the secondary winding 320 may occur.

As the primary winding 310 and the secondary winding 320 are stacked on each other, an electromagnetic induction phenomenon occurs in the primary winding 310 and the secondary winding 320. As a result, the high voltage primary power, which is transmitted to the primary winding 310, may be induced to the low voltage secondary power on the secondary winding 320 by the electromagnetic induction phenomenon. Here, the magnitude of the secondary power that is induced on the secondary winding 320 may be affected by the magnitude of the primary power, the number of turns of each of the windings 310 and 320, and the separation distance between the windings 310 and 320.

In particular, the primary winding 310 and the secondary winding 320 each have two ends, and each end of the primary winding 310 and the secondary winding 320 may be connected to the pin 500. Here, the pin 500 is a component that is connected to each of the windings 310 and 320 to transfer an input/output of a power source and may be connected to other terminals, elements, or devices.

Specific portions of the primary winding 310 and the secondary winding 320 may be exposed to the outside of the bobbin 200, which are referred to as "lead-out portions 311 and 321". That is, among the windings 310 and 320, the lead-out portions 311 and 321 are portions adjacent to the pins 500 and may correspond to portions between ends of the windings 310 and 320 and winding portions of the windings 310 and 320, respectively, and may be exposed on the pin portion 210 of the bobbin 200.

Meanwhile, the winding portions of the primary winding 310 and the secondary winding 320 and the insulating layer 400 that covers the winding portions may be located at the central portion 220 of the bobbin 200. Here, the primary winding 310 and the secondary winding 320 may be wound in a space between the barriers 600.

The barriers 600 are walls that are formed on both sides of the winding portion of each of the windings 310 and 320 and secure the separation distance (that is, an insulation distance) between the primary winding 310 and the secondary winding 320. That is, the primary winding 310 includes a winding portion in a space between the barriers 600 (hereinafter referred to as a "first barrier") provided on both sides of the layer thereof, and the secondary winding 320 includes a winding portion in a space between the barriers 600 (hereinafter referred to as a "second barrier") provided on both sides of the layer thereof. Accordingly, the winding portion end of the primary winding 310 and the winding portion end of the secondary winding 320 have an effect of being separated from each other by the space that is occupied by the first barrier and the second barrier. In particular, the barrier 600 is higher than the region of the winding portion of each of the windings 310 and 320. That is, each of the windings 310 and 320 is wound only in a space (hereinafter referred to as a "winding space") that is at a height lower than and between two barriers 600 provided on both sides of the winding portion of the primary winding 310 or the secondary winding 320. Accordingly, the greater the space occupied by the barrier 600 (the length of an arrow on a reference numeral '600' in FIG. 7) (hereinafter referred to as a "barrier distance"), the narrower the winding space for each of the windings 310 and 320. However, in each of the barriers 600, the barrier distances may not be the same.

Hereinafter, a design method according to the present disclosure to satisfy reinforced insulation in an insulation class will be described.

Each power source (or each winding) is insulated from each other, and here, an insulation criterion for safety, that is the 'insulation class', is determined between each power source (for example, between primary power sources, between secondary power sources, or between a primary power source and a secondary power source) depending on where each power source is used (internal or external).

Here, the terms "internal" and "external" refer to positions where the corresponding power source is used and are related to whether the user is in direct contact with the corresponding power source. That is, an internal power source is a primary power source or a secondary power source that is not in direct contact with the user and means a power source that is used only inside the device or apparatus. On the contrary, an external power source is a secondary power source that can directly contact the user and means a power source that may be exposed to the outside of the device or apparatus.

TABLE 1

| Insulation class | Target power source | (Primary power source for inverter) Minimum separation distance at 200 V | (Primary power source for inverter) Minimum separation distance at 400 V |
|---|---|---|---|
| Functional insulation | Between primary power sources<br>Between internal secondary power sources<br>Between external secondary power sources | 1.5 mm | 3 mm |
| Basic insulation | Between primary power source and internal secondary power source | 3 mm | 5.5 mm |
| Reinforced insulation | Between primary power source and external secondary power source<br>Between internal secondary power source and external secondary power source | 5.5 mm | 8 mm |

Referring to Table 1, the insulation class may be classified into three types, which are functional insulation, basic insulation, and reinforced insulation, and the reinforced insulation is the highest insulation criterion among them. That is, it may be seen that the degree of insulation criterion increases from the functional insulation to the reinforced insulation.

The functional insulation is a criterion between primary power sources, between internal secondary power sources, or between external secondary power sources. For example, for an inverter, when the primary power source is 200 V, in order to satisfy the functional insulation, the corresponding power sources must be separated at least 1.5 mm from each other. In addition, for an inverter, when the primary power source is 400 V, in order to satisfy the functional insulation, the corresponding power sources must be separated at least 3 mm from each other.

The basic insulation is a criterion between a primary power source and an internal secondary power source. For example, for an inverter, when the primary power source is 200 V, in order to satisfy the basic insulation, the corresponding power sources must be separated at least 3 mm from each other. In addition, for an inverter, when the primary power source is 400 V, in order to satisfy the basic insulation, the corresponding power sources must be separated at least 5.5 mm from each other.

The reinforced insulation is a criterion between a primary power source and an external secondary power source, or between an internal secondary power source and an external secondary power source. For example, for an inverter, when the primary power source is 200 V, in order to satisfy the reinforced insulation, the corresponding power sources must be separated at least 5.5 mm from each other. In addition, for an inverter, when the primary power source is 400 V, in order to satisfy the reinforced insulation, the corresponding power sources must be separated at least 8 mm from each other.

The present disclosure proposes a design method of the transformer that satisfies reinforced insulation. That is, according to the embodiment of the present disclosure, there is provided a transformer in which the insulation class between the primary power source and the secondary power source or between the secondary power sources (that is, between the primary winding 310 and the secondary windings 320 or between the secondary windings 320) satisfies the criterion of reinforced insulation.

Meanwhile, in the transformer, the separation distance between the primary winding 310 and the secondary winding 320 should satisfy the minimum separation distance that is presented by the corresponding insulation criterion. To this end, the vertical separation distance in the stacked portion of the primary winding 310 and the secondary winding 320 is designed to satisfy the corresponding minimum separation distance. In addition, the total barrier distance of the primary winding 310 and the secondary winding 320 is also designed to satisfy the corresponding minimum separation distance criterion.

Here, the total barrier distance means a sum between the barrier distance of the first barrier, which is provided at one side of the winding portion of the primary winding 310, and the barrier distance of the second barrier that is provided at one side of the winding portion of the secondary winding 320 adjacent to the primary winding 310. That is, the total barrier distance is the sum of the barrier distances of the first barrier that is located on a lower side and the second barrier that is located on an upper side.

However, in a conventional transformer, in order to satisfy the reinforced insulation criterion, the above-described separation distance must be increased such that a problem arises in that the volume of the transformer becomes large.

Meanwhile, even when it does not satisfy the criteria for the minimum separation distance, the corresponding insulation class may also be applied when a power line (first winding or second winding), which transmits the corresponding power, satisfies the criteria for withstand voltage. Here, the withstand voltage is affected by the degree of overlaps of an insulation outer layer of the winding or the thickness of the insulation outer layer. That is, as the insulation outer layer is composed of a plurality of layers and the number of overlapping layers increases, or the thickness of the insulation outer layer becomes thicker, the withstand voltage increases, and the insulation class may also be increased.

However, even in this case, the volume of the transformer should be minimized, and thus it may be more desirable that the insulation outer layer **320*b* of the secondary winding 320, rather than the primary winding 310, satisfies the above-described condition. This is because the number of turns of the secondary winding 320 is smaller than that of the primary winding 310 such that even when the above-described conditions are adopted, an increase in volume due to the adoption may be small. Accordingly, the present disclosure proposes an insulation class improvement that is obtained by an increase in withstand voltage (hereinafter referred to as a "first proposal") by designing the insulation outer layer 320*b* of the secondary winding 320 to have a greater number of overlaps or thicker than the insulation outer layer 310***a* of the primary winding 310.

When the secondary winding 320 is designed with a power line that satisfies the withstand voltage of a predetermined insulation class or more according to the first proposal, the minimum separation distance for the corresponding insulation class does not have to be satisfied. As a result, the total barrier distance for each of the primary winding 310 and the secondary winding 320 may be smaller than before.

Figure 8:
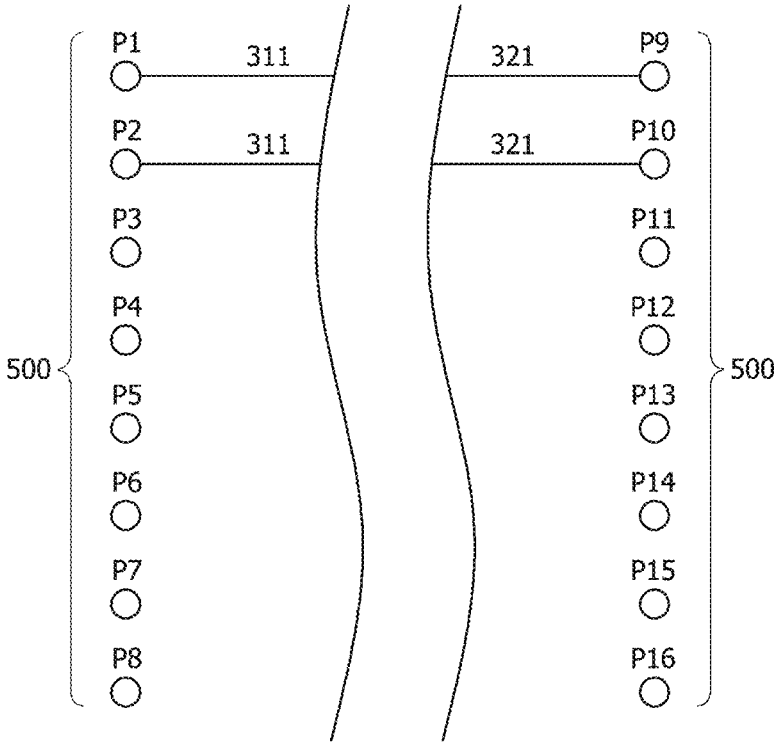
FIG. 8 illustrates a state in which lead-out portions (311 and 321) are connected to pins (500) in a conventional transformer.
Figure 9:
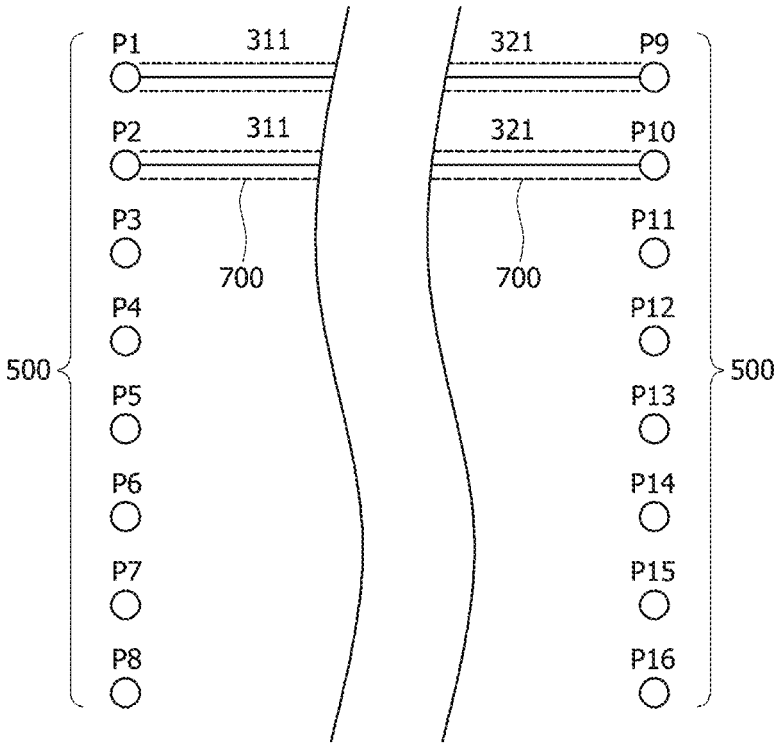
FIG. 9 illustrates a state in which lead-out portions (311 and 321) are connected to pins (500) in the reinforced insulation transformer according to an embodiment of the present disclosure.

FIG. 8 illustrates a state in which the lead-out portions 311 and 321 are connected to pins 500 in the conventional transformer, and FIG. 9 illustrates a state in which the lead-out portions 311 and 321 are connected to pins 500 in the reinforced insulation transformer according to the embodiment of the present disclosure.

Meanwhile, the lead-out portions 311 and 321 are portions that are exposed to the outside among the primary winding 310 and the secondary winding 320. Here, when the periphery of the lead-out portions 311 and 321 is additionally surrounded by an insulating tube 700, the withstand voltage or the minimum separation distance in the corresponding region may be increased, and as a result, the insulation class may be increased. Accordingly, the present disclosure further proposes an insulation class improvement that is obtained by designing the lead-out portions 311 and 321 to be additionally surrounded by the insulating tube 700 (hereinafter referred to as a "second proposal").

Here, the insulating tube 700 is a tube made of an insulating material. For example, the insulating tube 700 may include a Teflon tube that easily adheres to the periphery of the lead-out portions 311 and 321 by heating, but the present disclosure is not limited thereto.

Referring to FIG. 8, in the conventional transformer, the lead-out portions 311 and 321 are not additionally surrounded by the insulating tube 700. However, in the conventional transformer, there may be a case in which the lead-out portion 311 of the primary winding 310 is surrounded by the insulating tube 700, but the corresponding processing was not performed for the lead-out portion 321 of the secondary winding 320.

Meanwhile, in the transformer, when there are more than two cases that satisfy the basic insulation (hereinafter referred to as an "additional reinforced insulation condition"), it may be appreciated that between the corresponding power sources the reinforced insulation is satisfied according to the standard of the insulation class. That is, when each of the first proposal and the second proposal satisfies the basic insulation criterion for the additional reinforced insulation condition, the power sources of the transformer may satisfy the reinforced insulation.

Accordingly, when the secondary winding 320 is designed with a power line that satisfies the withstand voltage or more of the basic insulation according to the first proposal, and when it is designed such that the lead-out portion 321 of the secondary winding 320, in addition to the lead-out portion 311 of the primary winding 310, is also surrounded by the insulating tube 700 according to the second proposal to satisfy the basic insulation or more, the corresponding transformer may satisfy the basic insulation criterion twice or more. As a result, it is possible to implement the reinforced insulation for the corresponding transformer. In this case, in the corresponding transformer, the total barrier distance of each of the primary winding 310 and the secondary winding 320 may become smaller than the minimum separation distance for the reinforced insulation.

That is, by implementing the reinforced insulation through satisfying the basic insulation criterion twice as described above, the present disclosure may reduce the insulation distance (that is, the total barrier distance) between the primary power source and the secondary power source, which has been increased in the conventional implementation of the reinforced insulation, so that the size of the barrier 600 may be reduced. As a result, the present disclosure may increase the winding portion of each of the primary winding 310 and the secondary winding 320, that is, a winding window area.

The total barrier distance of each of the primary winding 310 and the secondary winding 320 needs to satisfy only the minimum separation distance of the basic insulation criterion (for example, 3 mm when the primary power source is 200 V, 5.5 mm when the primary power source is 400 V). Accordingly, each total barrier distance may be smaller than the minimum separation distance of the reinforced insulation criterion (for example, 5.5 mm when the primary power source is 200 V, 8 mm when the primary power source is 400 V). As a result, the present disclosure may minimize an increase in volume that has occurred conventionally, that is, an increase in volume to satisfy the total barrier distance in the reinforced insulation.

However, in relation to the first proposal, designing and manufacturing the power line directly for changing the withstand voltage to satisfy a specific insulation class in transformer design may increase manufacturing costs, and thus may not be easy in manufacturing conditions. On the other hand, the withstand voltage for each insulation class may be provided as a specification of the power line itself. Accordingly, the present disclosure proposes to use, as the secondary winding 320, a specific type of power line that satisfies the withstand voltage of the basic insulation among the various power lines on the market that are designed, manufactured and provided.

That is, such a specific type of power line may satisfy the withstand voltage of the basic insulation criterion by forming the insulation outer layer of the power line into a plurality of overlapping numbers. In particular, as shown in FIG. 7, in the specific type of power line, the insulation outer layer of the power line may have a triple layer. This is because when the number of overlapping layers of the insulation outer layer of the power line is less than 3, the withstand voltage of the basic insulation criterion may not be satisfied, and when the number of overlapping layers of the insulation outer layer of the power line is greater than 3, the secondary winding 320 may become too thick such that the volume occupied by the winding portion of the secondary winding 320 may be increased.

Figure 10:
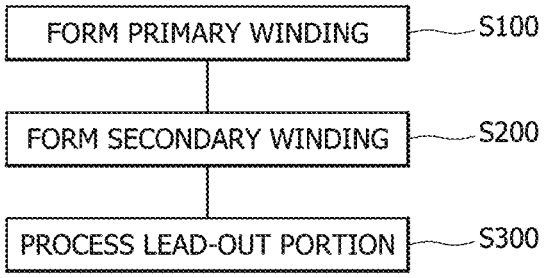
FIG. 10 illustrates a flowchart of a design method of the reinforced insulation transformer according to an embodiment of the present disclosure.

FIG. 10 illustrates a flowchart of a design method of a reinforced insulation transformer according to an embodiment of the present disclosure.

In summary, as shown in FIG. 10, the design method of the reinforced insulation transformer according to the embodiment of the present disclosure may include forming a primary winding (S100), forming a secondary winding (S200), and processing a lead-out portion (S300).

In S100, a primary winding 310 is formed by winding. Here, the primary winding 310 may be wound around a core 100, but the present disclosure is not limited thereto In S200, a secondary winding 320 is formed by winding on the primary winding 310 with a vertical separation distance therebetween. Here, an insulating layer 400 may be formed in a region of the vertical separation distance between the primary winding 310 and the secondary winding 320, but the present disclosure is not limited thereto. In particular, in S200, the primary winding 310 and the secondary winding 320 may satisfy the contents of the first proposal, the additional reinforced insulation condition, and the like.

In S300, the primary winding 310 and the secondary winding 320 are surrounded by an insulating tube 700 for each of lead-out portions 311 and 321 of the primary winding 310 and the secondary winding 320. That is, in S300, the primary winding 310 and the secondary winding 320 may satisfy the contents of the second proposal, the additional reinforced insulation condition, and the like.

However, in S100 to S300, each component of the transformer, in particular, the primary winding 310 and the secondary winding 320 may include contents described above with reference to FIGS. 1 to 9.

The present disclosure configured as described above has an advantage that a reinforced insulation structure between a primary power source and a secondary power source can be implemented with a minimum volume.

In particular, the present disclosure can reduce an insulation distance between a primary power source and a secondary power source, which has been increased in a conventional implementation of reinforced insulation, by implementing the reinforced insulation through the satisfaction of a basic insulation criterion twice so that the size of a barrier can be reduced, and as a result, a winding portion of each of a primary winding and a secondary winding, that is, a winding window area, can be increased.

However, effects to be achieved by embodiments of the present disclosure are not limited to the above-described effects, and other effects, which are not described above, may be clearly understood by those skilled in the art through the following specification.

While specific embodiments have been described in the detailed description of the present disclosure, various modifications may be made without departing from the scope of the present disclosure. Therefore, the scope of the present disclosure is defined not by the described embodiment but by the appended claims and encompasses equivalents that fall within the scope of the appended claims.

What is claimed is:

1. A reinforced insulation transformer, that satisfies a reinforced insulation criterion, according to a plurality of basic insulation standards, comprising:

a primary winding; and a secondary winding wound on the primary winding, wherein:

the primary winding and the secondary winding have a stacked structure, each of the primary winding and the secondary winding includes a conducting wire and an insulation outer layer that surrounds the conducting wire, and the insulation outer layer of the secondary winding has more layers or a greater thickness than the insulation outer layer of the primary winding, the insulation outer layer of the secondary winding is composed of a plurality of layers to satisfy a first withstand voltage of a first basic insulation standard of the plurality of basic insulation standards, a lead-out portion of each of the primary winding and the secondary winding is surrounded by an insulating tube to satisfy a second withstand voltage of a second basic insulation standard of the plurality of basic insulation standards, and the lead-out portion is adjacent to a pin, and a total barrier distance of each of the primary winding and the secondary winding satisfies the second withstand voltage of the second basic insulation standard of the plurality of basic insulation standards and is smaller than a separation distance of the reinforced insulation criterion specified for the second withstand voltage.

2. The reinforced insulation transformer of claim 1, wherein the insulation outer layer of the secondary winding has a triple layer.

3. The reinforced insulation transformer of claim 1, wherein the insulating tube includes a Teflon tube.

4. The reinforced insulation transformer of claim 1, wherein the reinforced insulation transformer is included as a configuration of a power supply for an inverter.

5. The reinforced insulation transformer of claim 4, the power supply comprising:

an input rectification smoothing circuit that performs rectification and smoothing functions for an input power;

a converter that converts the input power rectified and smoothed by the input rectification smoothing circuit; and an output rectification smoothing circuit for generating a final power by performing rectification and smoothing functions on the input power converted by the converter, wherein the reinforced insulation transformer is provided between the input rectification smoothing circuit and the converter, or between the converter and the output rectification smoothing circuit.

6. The reinforced insulation transformer of claim 5, the reinforced insulation transformer is provided between the input rectification smoothing circuit and the converter, and receives smoothed power as an input of the primary winding, and delivers reduced power to the converter through an output of the secondary winding.

7. The reinforced insulation transformer of claim 5, the reinforced insulation transformer is provided between the converter and the output rectification smoothing circuit, and receives the input power converted by the converter as an input of the primary winding, and delivers reduced power to the output rectification smoothing circuit through an output of the secondary winding.

8. The reinforced insulation transformer of claim 1, wherein the insulation outer layer of the secondary winding has more layers than the insulation outer layer of the primary winding.

9. The reinforced insulation transformer of claim 1, wherein a first basic insulation standard of the plurality of basic insulation standards specifies a first minimum separation distance at 200 Volts (V) of 3 millimeters (mm) and a second basic insulation standard of the plurality of basic insulation standards specifies a second minimum separation distance at 400V of 5.5 mm.

10. The reinforced insulation transformer of claim 9, wherein the total barrier distance of each of the primary winding and the secondary winding is less than 5.5 mm, when the reinforced insulation criterion specifies a minimum reinforced separation distance at 200 Volts (V) be at least 5.5 mm.

11. The reinforced insulation transformer of claim 9, wherein the total barrier distance of each of the primary winding and the secondary winding is less than 8 mm, when the reinforced insulation criterion specifies a minimum reinforced separation distance at 400 Volts (V) be at least 8 mm.

12. The reinforced insulation transformer of claim 1, wherein the reinforced insulation criterion specifies a first minimum reinforced separation distance at 200 Volts (V) of 5.5 millimeters (mm) and a second minimum reinforced separation distance at 400V of 8 mm.

13. A design method of a reinforced insulation transformer in which a primary winding and a secondary winding form a stacked structure and a reinforced insulation criterion is satisfied according to the satisfaction of two or more basic insulation standards, the design method comprising:

forming the primary winding by winding; and forming the secondary winding by winding on the primary winding, wherein each of the primary winding and the secondary winding includes a conducting wire and an insulation outer layer that surrounds the conducting wire, and the insulation outer layer of the secondary winding has more layers or a greater thickness than the insulation outer layer of the primary winding, wherein:

the insulation outer layer of the secondary winding is composed of a plurality of layers to satisfy a first withstand voltage of a first basic insulation standard of the plurality of basic insulation standards, a lead-out portion of each of the primary winding and the secondary winding is surrounded by an insulating tube to satisfy a second withstand voltage of a second basic insulation standard of the plurality of basic insulation standards, and the lead-out portion is adjacent to a pin, and a total barrier distance of each of the primary winding and the secondary winding satisfies the second withstand voltage of the second basic insulation standard of the plurality of basic insulation standards and is smaller than a separation distance of the reinforced insulation criterion specified for the second withstand voltage.

14. A reinforced insulation transformer, comprising:

a primary winding, including a first conductive wire and a first insulation outer layer that surrounds the first conductive wire; and a secondary winding wound on the primary winding in a stacked structure with the primary winding, the secondary winding including a second conductive wire and a second insulation outer layer that surrounds the second conductive wire, wherein the second insulation outer layer is thicker than the first outer insulation layer.

15. The reinforced insulation transformer of claim 14, wherein the second insulation outer layer is thicker than the first insulation outer layer due to the second insulation outer layer having more overlaps of an insulating layer used to cover the primary winding and the secondary winding.

* * * * *